United States Patent [19]

Grant

[11] 3,931,965

[45] Jan. 13, 1976

[54] NET POST RETENTION DEVICE

[76] Inventor: Marshall D. Grant, Drawer No. 3128, El Paso, Tex. 79923

[22] Filed: Aug. 13, 1974

[21] Appl. No.: 497,059

[52] U.S. Cl. ..... 273/29 BF; 256/37

[51] Int. Cl.[2] ..... A63B 61/00

[58] Field of Search ..... 273/29 B, 29 BB, 29 BC, 273/29 BD, 29 BF, 29 BG, 29 BE, 95 R; 119/122, 123; 292/256, 305; 256/37, 1; 249/143

[56] References Cited

UNITED STATES PATENTS

| | | | |
|---|---|---|---|
| 1,691,480 | 11/1928 | Hirst et al. | 273/29 BA |

FOREIGN PATENTS OR APPLICATIONS

| | | | |
|---|---|---|---|
| 397,950 | 9/1933 | United Kingdom | 273/29 BE |
| 326,000 | 3/1930 | United Kingdom | 273/29 BD |

*Primary Examiner*—Richard C. Pinkham
*Assistant Examiner*—T. Brown
*Attorney, Agent, or Firm*—James J. Brown

[57] ABSTRACT

A post for supporting tennis nets, volley ball nets and other nets of similar purpose that provides a maximum safety advantage to the players of said games, yet offering a device of strict simplicity comprising a minimum of movable parts and which strongly resists bending or breakage under high tension, shear, or compression loadings. The game net support post is telescopically insertable and removably placed in a support surface socket, the post being substantially rectangular in cross-section. Placed near the lower end of the post is a transverse bolt for limiting downward movement of the post within the socket. The upper end of the post is provided with a transverse recessed trough. The trough is extended across the upper horizontal surface and a short distance down one of the sides of the post. Attached to the side of the post is an elongated turnbuckle. The turnbuckle has one of its ends attached to the side of the post on which the trough extends. The other end of the turnbuckle is attached to an end of a cable of a game net which has one of its ends attached to a stationary point and its other end extending across a game court playing surface to the post remote from the stationary point. The cable is placed in the trough of the post and then attached to the other end of the turnbuckle for being tensioned by the turnbuckle. A transverse bolt is provided with structure for attaching the game net. A covering is provided for the post which conceals the upper edge and side of the post to which the turnbuckle is attached.

6 Claims, 5 Drawing Figures

FIG. 2
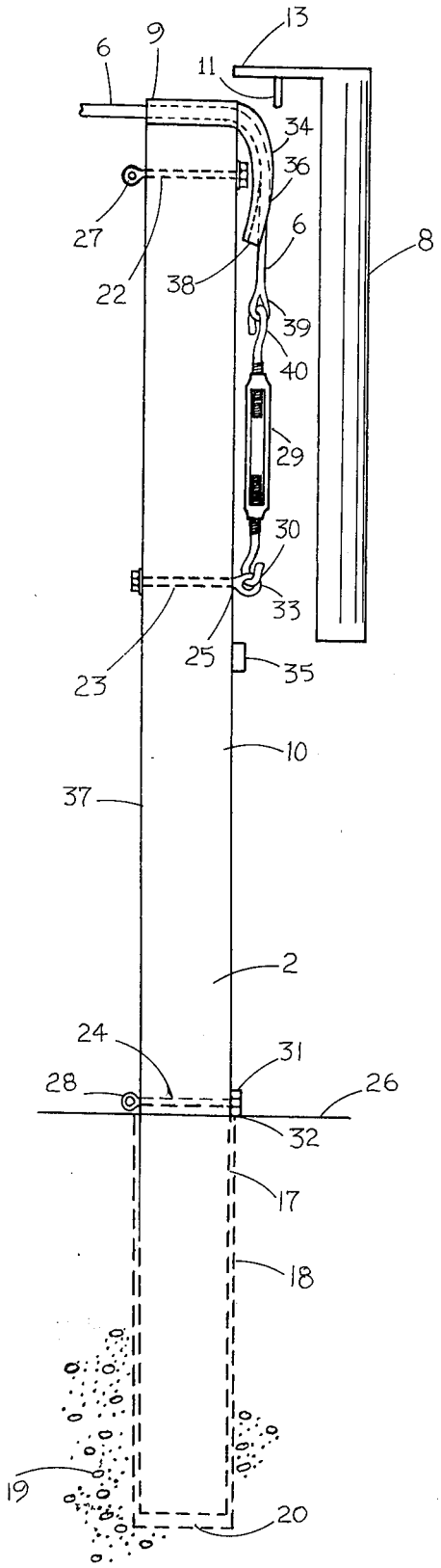
FIG. 3
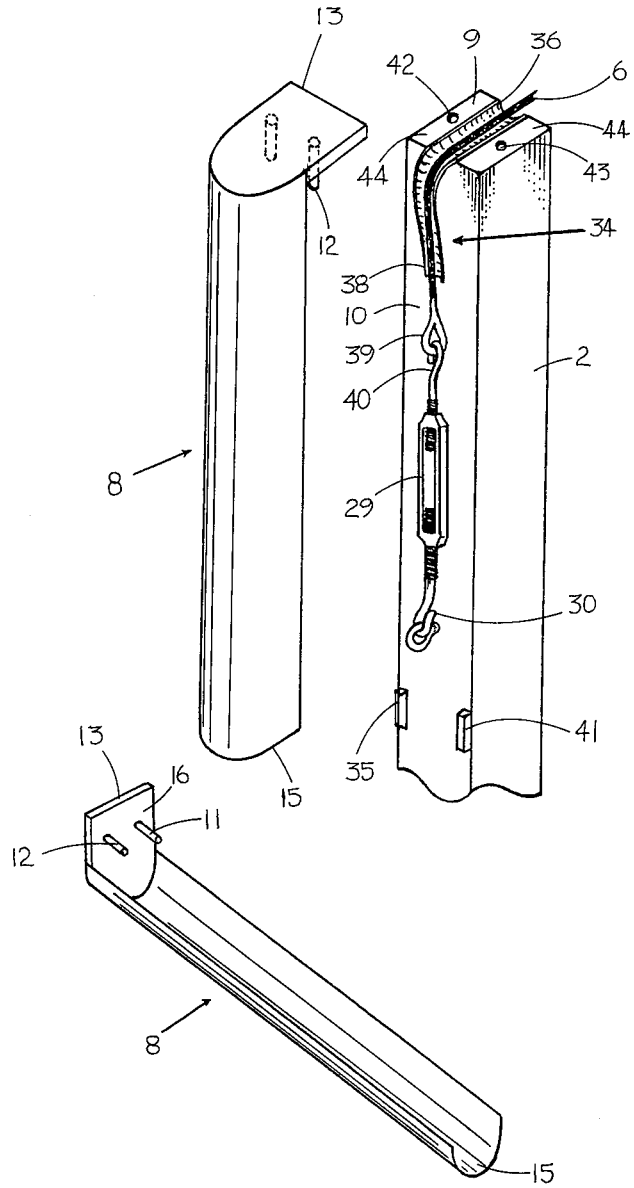
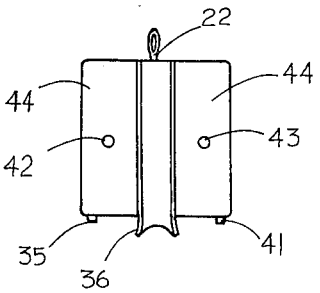
FIG. 4
FIG. 5

NET POST RETENTION DEVICE

BACKGROUND OF THE INVENTION

The games of tennis, volley ball and other similar games throughout the term of play require player personnel to constantly move about the playing court at a fast run and to assume off balance positions while directing their vision primarily to the location, position and direction of movement of a ball or puck. Such circumstance makes the players extremely vulnerable to tripping, slipping, falling, or collision accidents. Therefore, it is extremely important that the playing court be as free as possible from obstructions, protrusions or other hazards that may cause or increase injury, should the player accidently slip, trip or fall into or collide with an obstruction or protrusion. The net post— a required item in games involving play in the vicinity of a stretched net— is well known as a major cause of player injury. Such posts most normally are replete with exposed handles, pulleys, stays, hinges and other devices that increase player injury in accidents in which players collide or fall into net posts, thus increasing the hazards of play. In addition to being a major cause of serious accidents on the playing courts, currently employed net posts possess operational deficiencies in that gears and teeth of employed winding mechanisms strip and break, thus rendering the post imoperative. Bending or breaking of net posts due to applied net stretching tensions is also a common occurrence.

The present invention overcomes the disadvantages of net posts currently employed in net related games by providing a net post void of protruding handles, winding mechanisms, stays, hinges and other protruding devices that could increase player injury in net post player collision and also by providing a net post of sufficient strength and design configuration that bending or breaking of the net post is effectively avoided. Further, the present invention eliminates gear stripping problems currently experienced by the employment of a minimum number of moving parts.

SUMMARY OF THE INVENTION

The present invention relates to an improved rectilinear net post or standard designed to support steel or fabric game nets such as tennis nets, volley ball nets and the like being devoid of moving parts and surface protrusions, thereby substantially reducing serious player injuries frequently experienced in games of tennis, volley ball and like action games which are the result of players' inadvertently colliding with fixed position net posts. Further, the net post device is so constructed that bending or breaking of the post under extreme overload conditions is precluded and operational failure of included net tension devices prevented by the exclusion of moving mechanical components.

An important object of this invention is to provide for the safety of players involved in action games employing tension mounted nets by removing injury causing protrusion from supporting net posts, thereby effectively removing them from the playing area.

Another object of this invention is to provide an efficient and economical means of supporting nets employed in action games such as tennis.

A further object of this invention is to provide a net post for action games such as tennis that effectively resists deformity or breaking under extreme tension, compression or shear loadings.

Yet another object of this invention is to provide a net post for action games, such as tennis, that is void of moving mechanical components and mechanisms.

A still further object of this invention is to provide a reliable net post for action games, such as tennis, that will provide fail safe operation of the net post and its tensioning devices.

These and other objects are accomplished according to the present invention which comprises a hollow tube being open at its lower terminus and being fitted at its upper terminus with a non-mechanical cable guide and a removable upper cover which evolves into a semi-circular longitudinal side cover. Said tube being drilled to receive a plurality of tension and retention net attachment devices. The aforesaid apparatus, when employed in pairs and permanently mounted a distance apart on opposite sides of a game playing court, comprises as an entity a set of net support and tensioning devices commonly known as net posts.

These together with other objects and advantages which will become subsequently apparent reside in the details of construction and operation as more fully hereinafter described and claimed, reference being had to the accompanying drawings forming a part hereof, wherein like numerals refer to like parts throughout, and in which:

FIG. 2 is a side plan view.

FIG. 3 is a perspective view illustrating the net post construction and the net tensioning mechanism.

FIG. 4 is a perspective view of the post's side top and top cover.

FIG. 5 is a top plan view of the net post with cover removed.

Figure 1:
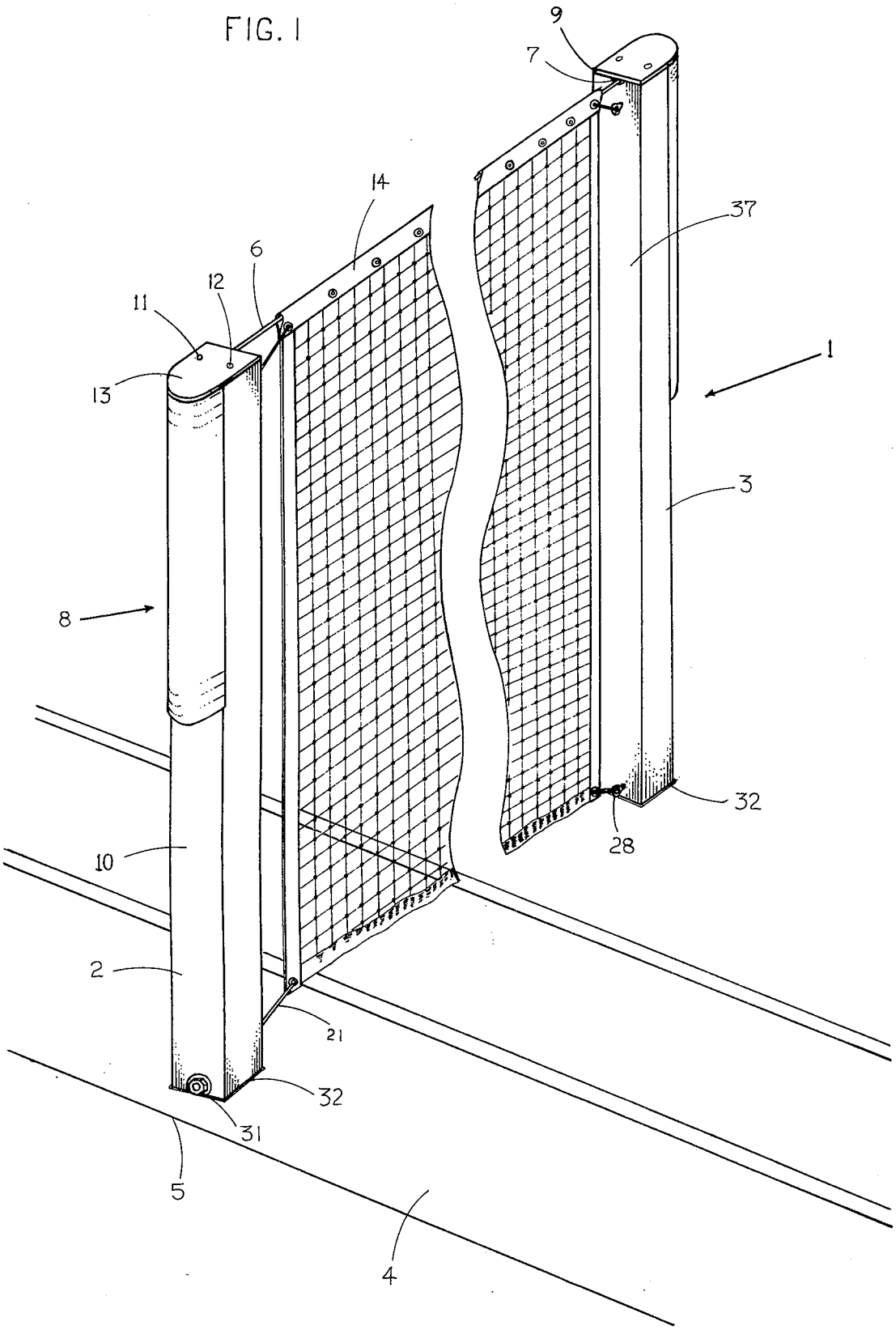
FIG. 1 is a perspective view, on a reduced scale, of a net post depicting the present invention.

Referring now specifically to the drawings, the numeral 1 generally designates the net post assembly of the present invention, the numeral 8 generally designates the cover of the tensioning and retention mechanism, the numeral 34 generally designates a non-mechanical cable guide.

FIG. 1, a preferred embodiment of the present invention, is shown which comprises a pair of identically constructed polygonal or rectilinear hollow net posts (2) and (3) which are disposed in vertical relation and parallel spaced relation on opposite sides of a tennis court (4) at the midpoint (5) of the court (4). Said net posts (2) and (3) being connected by a net supporting metallic cable (6) which is received within a small opening (7), whereupon the metallic cable (6) proceeds within the confines of cover (8) to the enclosed tensioning and retention devices to which it is firmly attached. The hollow uprights (2) and (3), the subject of the present invention as previously stated, are identically constructed; therefore further description will only consider net post (2) and its various components. As shown in FIG. 1, net post (2) comprises a cross-sectionally square or polygonal, rectilinear, hollow upright possessing an elongated curvilinear cover (8), that extends from the upper terminus (9) of said upright (2) downward along its outer face (10) for a distance approximately equal to one third of the total length of upright (2). Said cover (8) being attached to upright (2) by a plurality of pins (11) and (12) which are permanently affixed to the cover's (8) top cap (13) which extends horizontally across the upper terminus (9) of upright (2). The purpose of cover (8) being to completely enclose the tensioning and retention devices employed to suspend net (14). Referring to FIG. 2, 3 and 4, tensioning device cover (8) comprises an elongated metallic semi-circular trough (15) fitted with a permanently attached metallic cap (13) at its upper terminus. Said cap (13) possessing two elongated pins (11) and (12) that protrude perpendicularly from its lower surface (16). The tensioning device cover, when installed in place on net post (2) as described above, cowles the tensioning and restraint devices mounted on the outer face (10) of net post (2) to provide a smooth and non-protruding outer surface, thus assisting in the removal of injury causing irregular shapes from the playing area. The lower end (17) of net post (2) is received within metallic casing (18) which is firmly held in place below the ground level of the court by a poured concrete foundation (19). The metallic casing (18), in addition to providing strict vertical alignment of net post (2), is capped at its lower terminus with a permanently attached metallic plate (20) which serves to prevent foreign matter from entering said casing.

FIGS. 2, 3, 4 and 5 illustrate the net post construction and the mechanism for tensioning and restraint of net cable (6). The device includes a cross-sectionally square or polygonal, metallic, rectilinear tube (2) to which have been fitted a plurality of eye-bolts (22), (23), (24) in such a manner that said eye-bolts penetrate the tube (2) along its horizontal axis perpendicularly to the tube's (2) vertical axis being spaced apart an equal distance along the vertical axis of tube (2) when measured from the midpoint (25) of that portion of tube (2) which extends above the surface level of the court (26). Said eyebolts (22), (23) and (24) being oriented in such a manner that the eye (33) of the center eyebolt (23) is located on the side of tube (2) that faces away from the court (4) and with eyes (27) and (28) of eyebolts (22) and (24) respectively being so oriented that they face inward toward the court (4). The center eyebolt (23) which is of heavy duty stock serves as the anchor point for the net tensioning turnbuckle (29) at its lower terminus (30). Eyebolts (22) and (24), being fabricated from lighter stock than eyebolt (23), serve to receive and retain net lacing and tying cords (21) to assist in maintaining the ends of nets suspended between net posts (2) and (3) in a parallel relationship with the vertical axis of net posts (2) and (3). Additionally, the eyebolt retention nut (31) of eyebolt (24) serves as a stop to control the distance that the net post (2) decends into its support casing (18), thus effectively setting the height that post (2) extends above the playing surface. The retention nut (31), which extends a slight distance beyond the outer diameter of the net post during decent into the casing, comes in contact with upper rim (32) of casing (18), thus precluding further downward travel of the post (2). The eyebolt installation described above is designed to suspend nets fabricated from soft and flexible materials such as nylon, cotton, hemp or other like materials. The present invention with minor modification may also be employed to suspend metallic nets fabricated from steel or other similar metals possessing similar characteristics. Modifications required to suspend metallic nets include the reversal of the direction of insertion of eyebolt (23) so as to place its eye (33) on the side of tube (2) that faces toward the court (4) and the removal of turnbuckle (29). Said metallic net being attached directly to and suspended only by eyebolts (22), (23) and (24).

FIG. 3, the upper terminus (9) of tube (2) is fitted with a non-mechanical cable guide (34) comprised of an elongated semicircular trough (36) that lies parallel to the horizontal across the width of the net post (2) and being centered on the horizontal axis of said post (2). The semicircular trough (36) is so fitted that the open portion of the trough faces upward and that longitudinally said trough is perpendicular to the walls (37) and (10) of the post that comprise the post's inner and outer faces respectively. Widthwise the trough is flush with the inner post face (37) and extends across the upper terminus (9) of post (2) to a slight distance beyond the outer face (10) of post (2), whereupon said trough curls downward in an arc to such position that the lower terminus (38) of the trough (36) approaches the vertical. The elongated trough (36) serves as a cable guide for net cable (6) across the upper terminus (9) of net post (2) and down its outer face (10) whereupon the net cable (6) by means of a fixed loop (39) engages the upper hook (40) of restrained turnbuckle (29) which acts as the cable tensioning mechanism of cable (6). The holes (42) and (43) drilled into the fill material (44) on either side of trough (36) serve to anchor pins (11) and (12) which cooperate with cover guides (35) and (41) to restrain and maintain the alignment of tensioning device cover (8) when it is attached to tube (2).

It is to be understood that while the detailed drawings and specific examples given describe preferred embodiments of the invention they are for the purposes of illustration only, that the apparatus of the invention is not limited to the precise details and conditions disclosed, and the various changes may be made therein without departing from the spirit of the invention which is defined by the following claims.

What is claimed is:

1. A device for positioning and tensioning over a playing surface a vertically hanging game net having at least a top cable having at least one of its ends attached to a stationary point, said device comprising an upright post having a lower portion adapted to fit in a hole and an upper portion extending vertically upward for a height sufficient to accommodate the net; said upper portion of the upright post having means affixed thereto at about the upper and lower extremity thereof for attaching the net; the upper end of said post having disposed therein a recessed trough means for accommodating the top cable of the net to be attached; said trough means extending slightly beyond the top of the post and curving in an arc downward along the side of the post a short distance; turnbuckle means for tensioning the top cable of the net to be attached disposed vertically along the upper portion of said post on the same side thereof as the downward projecting trough means; said turnbuckle means being attached at its lower end to said post and having its upper end adapted for attachment to the top cable of the net to be attached; cover means removably fitted to the upper end and side of said post and adapted to enclose said turnbuckle and trough means to protect players from contact with said turnbuckle and trough means; and stop means affixed to said upright post for maintaining the post at the proper height above ground level.

2. The device of claim 1 wherein said cover means is attached to the upper end of said post by a plurality of downward projecting pins adapted to fit in vertically disposed holes on either side of said trough means.

3. The device of claim 2 wherein there are two of said downwardly projecting pins.

4. The device of claim 1 wherein said post is hollow and of polygonal cross section.

5. The device of claim 4 wherein said hollow post is rectilinear in cross section.

6. The device of claim 1 wherein the means for affixing the net to the post at its lower extremity also is said stop means for maintaining the post at the proper height above ground level.

* * * * *